US006301858B1

(12) United States Patent
Crandell

(10) Patent No.: US 6,301,858 B1
(45) Date of Patent: Oct. 16, 2001

(54) SEALANT SYSTEM FOR AN INSULATING GLASS UNIT

(75) Inventor: Stephen L. Crandell, Cranberry Twp., PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/398,645

(22) Filed: Sep. 17, 1999

(51) Int. Cl.[7] ..... E04C 2/54
(52) U.S. Cl. ..... 52/786.13; 428/34
(58) Field of Search ..... 52/786.1, 786.13, 52/745.15; 428/34, 38, 46

(56) References Cited

U.S. PATENT DOCUMENTS

| | | | | |
|---|---|---|---|---|
| 3,280,523 | * | 10/1966 | Stroud | 428/34 |
| 4,080,482 | * | 3/1978 | Lacombe | 428/34 |
| 4,171,601 | * | 10/1979 | Gotz | 52/786.13 |
| 4,193,236 | | 3/1980 | Mazzoni et al. . | |
| 4,464,874 | | 8/1984 | Shea, Jr. et al. . | |
| 4,564,540 | * | 1/1986 | Davies et al. | 428/34 |
| 4,756,783 | * | 7/1988 | McShane | 428/34 X |
| 5,088,258 | | 2/1992 | Schield et al. . | |
| 5,106,663 | | 4/1992 | Box . | |
| 5,177,916 | | 1/1993 | Misera et al. . | |
| 5,255,481 | | 10/1993 | Misera et al. . | |
| 5,351,451 | | 10/1994 | Misera et al. . | |
| 5,501,013 | | 3/1996 | Misera et al. . | |
| 5,640,815 | * | 6/1997 | Chinzi | 52/786.13 X |
| 5,655,282 | | 8/1997 | Hodek et al. . | |
| 5,675,944 | | 10/1997 | Kerr et al. . | |
| 5,679,419 | * | 10/1997 | Larsen | 52/786.1 X |
| 5,691,045 | | 11/1997 | Lafond . | |
| 5,761,946 | | 6/1998 | Misera et al. . | |

FOREIGN PATENT DOCUMENTS

| | | |
|---|---|---|
| 0 065 510 | 11/1982 | (EP) . |
| 0 586 121 | 3/1994 | (EP) . |

* cited by examiner

*Primary Examiner*—Peter M. Cuomo
*Assistant Examiner*—Hanh V. Tran
(74) *Attorney, Agent, or Firm*—Donald C. Lepiane

(57) ABSTRACT

An insulating glass unit is provided having a first glass sheet spaced from a second glass sheet by a spacer frame. The spacer frame, preferably a flexible spacer frame, has a first side and a second side, with the first side located adjacent an inner-surface of the first glass sheet and the second side located adjacent the inner-surface of the second glass sheet. A sealant system, e.g. a three component sealant system, is provided adjacent each side of the spacer frame, e.g. by forming or flowing the sealant system on the outer surface of the spacer frame, to hold the glass sheets to the spacer frame. The sealant system includes a first structural sealant, such as a thermosetting material, spaced from a second structural sealant, such as another or the same thermosetting material. A moisture barrier material, preferably a thermoplastic material such as PIB, is located between the first and second structural sealant materials.

20 Claims, 2 Drawing Sheets

SEALANT SYSTEM FOR AN INSULATING GLASS UNIT

BACKGROUND OF THE INVENTION

1. Field of the Invention

This invention relates generally to an insulating glass unit and, in particular, to a moisture impervious sealant system for an insulating glass unit and a method of making same.

2. Description of the Currently Available Technology

It is well recognized that insulating glass (IG) units reduce the heat transfer between the outside and inside of a building or other structure. Examples of IG units are disclosed in U.S. Pat. Nos. 4,193,236; 4,464,874; 5,088,258; and 5,106,663 and European reference EP 65510, the teachings of which are herein incorporated by reference. A sealant system or edge seal structure of the prior art is shown in FIG. 1. The IG unit 10 of FIG. 1 includes two spaced apart glass sheets 12 and 13 adhesively bonded to a rigid spacer frame 14 by a sealant system 15 to provide a chamber 16 between the two glass sheets 12 and 13. The chamber 16 can be filled with a selected atmosphere, such as argon or krypton gas, to enhance the performance characteristics of the IG unit 10. The sealant system 15 bonding the glass sheets 12 and 13 to the spacer frame 14 are expected to provide structural strength to maintain the unity of the IG unit 10 and prevent gas leaking out of the chamber 16 or the atmosphere from outside the IG unit 10 from moving into the chamber 16. The sealant system 15 includes a layer 17 of moisture resistant sealant at the upper section of the spacer 14 to prevent the ingress and egress of gas into and out of the chamber 16 and a layer 18 of a structural type sealant, such as silicone to secure the sheets to the spacer. A moisture resistant sealant usually used in the art is polyisobutylene (PIB).

In addition to adhering the two glass sheets 12 and 13 to the spacer frame 14 and forming a moisture impervious barrier, the sealant system 15 should accommodate the natural tendency for the edges of the glass sheets 12 and 13 to rotate or flex due to changes in atmospheric pressure in the chamber 16 as a result of temperature, wind load and altitude changes, such as when an IG unit is manufactured at one altitude and installed at a different altitude. The spacer and selected sealant system should maintain the structural integrity of the IG unit as well as the sealing properties of the edge seal structure even during such changes.

As will be appreciated, box spacer frames 14, such as shown in FIG. 1, are not well suited for allowing such flexibility. For example and with reference to FIG. 2, as the distance between the sheets 12 and 13 increases because of pressure differences inside and outside of the chamber 16, the sealant system 15, in particular the layer 17 of the moisture resistant sealant, stretches and thins under stress, which decreases its ability to prevent atmospheric air from moving into and/or gas escape from the chamber 16. With rigid, box spacer frames, the structural sealant system 15 tends to become over stressed with time and fails prematurely. Additionally, the rigid spacer frame itself may become over-stressed and may collapse or deform or the glass sheets may become over-stressed at the edges and crack. Further, if the chamber between the glass sheets is filled with gas such as argon, krypton or other such insulating gas, the deformation of the sealants 17 and 18 and/or spacer frame 14 often results in accelerated loss of those gases from the chamber into the surrounding atmosphere.

An alternative to the prior art arrangement shown in FIG. 1 is to use a more flexible spacer frame, e.g. of the type disclosed in U.S. Pat. Nos. 5,655,282; 5,675,944; 5,177,916; 5,255,481; 5,351,451; 5,501,013; and 5,761,946, the teachings of which are herein incorporated by reference. While such flexible spacer frames help alleviate some of the problems encountered with rigid spacer frames, the use of flexible spacer frames in and of themselves may not completely eliminate the edge breakage and vapor and/or gas transmission problems associated with known edge seal and/or IG unit construction.

Therefore, it would be advantageous to provide an IG unit having a sealant system which reduces or eliminates the problems associated with known spacer frame and adhesive construction and a method of fabricating such an IG unit.

SUMMARY OF THE INVENTION

An insulating glass unit is provided having a first glass sheet spaced from a second glass sheet by a spacer frame. The spacer frame, preferably a flexible spacer frame, has a first side and a second side, with the first side located adjacent an inner-surface of the first glass sheet and the second side located adjacent the inner-surface of the second glass sheet. A sealant system incorporating features of the invention is provided on each side of the spacer frame to hold the glass sheets to the spacer frame. The sealant system includes a first structural sealant, preferably a thermosetting material, spaced from a second structural sealant, such as another or the same thermosetting material. A moisture barrier or moisture impervious material, preferably a thermoplastic material such as PIB, is located between the first and second structural sealant materials.

A method is also provided for making and using the sealant system of the invention for an insulating glass unit. A spacer frame is provided between a pair of glass sheets to provide a chamber therebetween. The spacer frame is preferably a flexible spacer frame fabricated by bending or forming a spacer stock. The spacer frame has a base and two spaced apart legs joined to the base to provide a substantially U-shape. The sealant system is applied to the spacer frame, e.g. beads of sealant material are provided onto the outer surfaces of the spacer frame, e.g. onto the outer surfaces of the legs and optionally onto the outer surface of the base. The sealant system includes a bead of low moisture vapor transmission or moisture barrier material, e.g., a thermoplastic material such as polyisobutylene or hot melt butyl, located between two beads of structural sealant, e.g., a thermoset material such as a silicone containing adhesive. The glass sheets are secured to the spacer frame by the sealant system.

DESCRIPTION OF THE PREFERRED EMBODIMENTS

Figure 1:
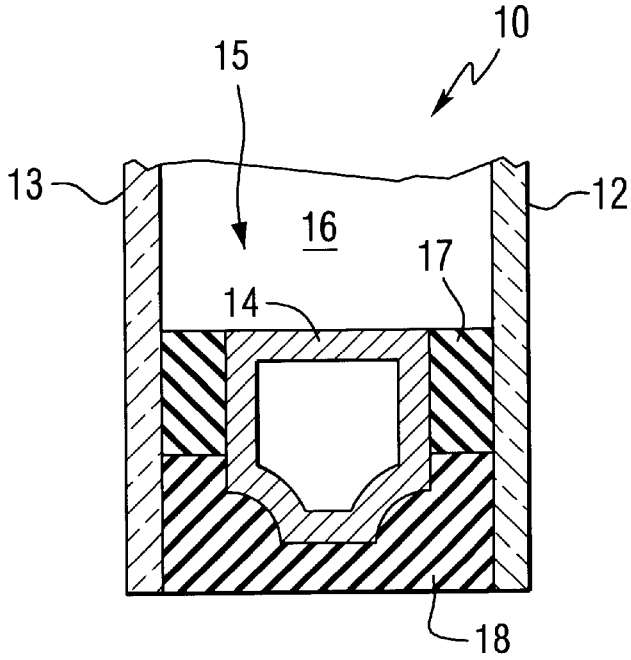
FIG. 1 PRIOR ART
FIG. 1 is a sectional view of an edge assembly of a prior art IG unit.

For purposes of the description hereinafter, spatial or directional terms such as "inner", "outer", "left", "right", "back" shall relate to the invention as it is shown in the drawing figures. However, it is to be understood that the invention may assume various alternative orientations and step sequences without departing from the inventive concepts disclosed herein. Accordingly, such terms are not to be considered as limiting.

Figure 3:
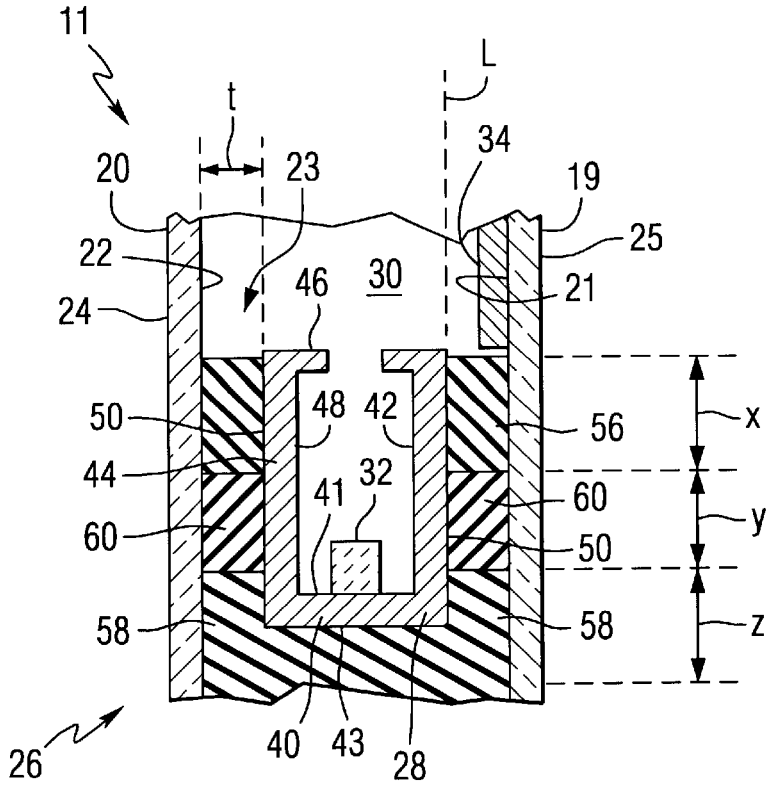
FIG. 3 is a sectional view of an edge assembly of an IG unit having a sealant system incorporating features of the invention.
Figure 4:
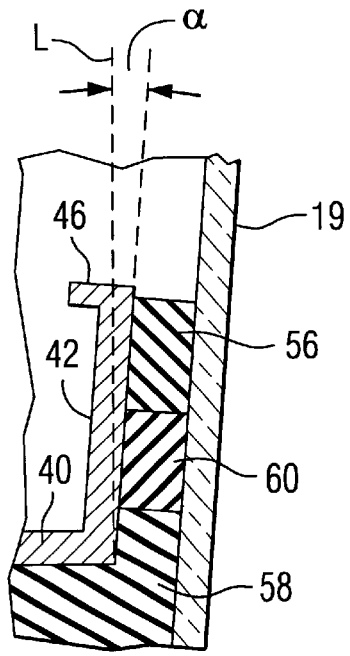
FIG. 4 is a sectional view of the right side of the edge assembly of FIG. 3 when stress is applied to the IG unit.

A portion of an IG unit 11 having a sealant system 23 incorporating features of the invention is shown in FIGS. 3 and 4. The IG unit 11 has a first glass sheet 19 with an inner surface 21 and an outer surface 25. The first glass sheet 19 is spaced from a second glass sheet 20 having an inner surface 22 and an outer surface 24. The distance between the two glass sheets 19 and 20 is maintained by an edge assembly 26 having a spacer frame 28 which is adhesively bonded to the two glass sheets 19 and 20 by the sealant system 23. Although not limiting to the invention, the two glass sheets 19 and 20 may be spaced about a half an inch, more preferably about 0.47 inch (about 1.20 cm) apart to form a chamber 30 or "dead space" between the two glass sheets 19 and 20. The chamber 30 can be filled with an insulating gas such as argon or krypton. A desiccant material 32 may be adhesively bonded to one of the inner surfaces of the spacer frame 28 in any convenient manner. E.g. as shown in FIG. 3 to inner surface 41 of the base 40 of the spacer frame 28.

The two glass sheets 19 and 20 may be clear glass, e.g., clear float glass, or one or both of the glass sheets 19 and 20 could be colored glass. A functional coating 34, such as a solar control or low emissivity coating, may be applied in any conventional manner, such as MSVD, CVD, pyrolysis, sol-gel, etc., to a surface, e.g., an inner surface, of at least one of the glass sheets 19 or 20.

The spacer frame 28 itself may be a conventional rigid or box-type spacer frame as is known in the art, e.g. as shown in FIG. 1. However, it is preferred that the spacer frame 28 be a flexible-type spacer frame which may be formed from a piece of metal, such as 201 or 304 stainless steel, or tin plated steel and bent and shaped into a substantially U-shaped, continuous spacer frame as described hereinbelow. The spacer frame 28 is adhesively bonded around the perimeter or edges of the spaced glass sheets 19 and 20 by the sealant system 23.

The spacer frame 28 shown in FIGS. 3 and 4 may be formed in conventional manner from a piece of metal, e.g. steel, having a thickness of about 0.010 inch (0.025 cm). The spacer frame 28 includes a base 40 having an inner surface 41, an outer surface 43 and a width of about 0.25–0.875 in (0.64 cm to 2.22 cm). The spacer frame 28 has opposed first and second sides defined by a pair of opposed legs 42 and 44, respectively, which extend from the base 40. Each leg 42,44 has a length of about 0.300 inch (0.76 cm) with a stiffening element 46 having a length of about 0.05 to 0.08 inch (0.13 to 0.02 cm) formed on the outer end of each leg 42,44. Each stiffening element 46 has a longitudinal axis which extends transverse, e.g. substantially perpendicularly, to the longitudinal axis L of its associated leg 42,44. The spacer 28 is configured such that each leg 42,44 is substantially flexible to provide for movement of the glass sheets 19 and 20 due to pressure or atmospheric changes as shown in FIG. 4 and discussed further hereinbelow. Preferably, each leg 42,44 is sufficiently flexible to be deflectable by at least about 0.5–1.0 degree from the neutral position shown in FIG. 3 in which each plane having one of the legs 42,44 is substantially perpendicular to a plane having the base 40. Each leg 42,44 includes an inner surface 48 facing the interior of the IG unit 11 and an outer surface 50 facing the inner surface 21 or 22 of the adjacent glass sheet 19 or 20. Although it is preferred that the spacer frame 28 be metal, the invention is not limited to metal spacer frames. The spacer frame 28 could be made of a polymeric material, e.g., halogenated polymeric material such as polyvinylidene chloride or fluoride or polyvinyl chloride or polytrichlorofluoro ethylene. The spacer frame 28 should be "structurally sound", meaning that the spacer frame 28 maintains the glass sheets 19 and 20 in spaced relationship while permitting local flexure of the glass sheets 19 and 20 due to changes in barometric pressure, temperature and wind load.

The sealant system 23 of the invention formed between the outer surface of the spacer frame 28, e.g. the outer surface 50 of a spacer leg 42,44 and the inner surface 21 or 22 of its associated glass sheet 14 or 20, will now be described. The sealant system 23 is preferably a "triple seal" system utilizing three separate or distinct sealant regions utilizing both structural sealants and a moisture barrier sealant, such as a moisture resistant or low moisture vapor transmission rate (MVTR) sealant. As used herein, the terms moisture barrier, moisture resistant or low MVTR sealant refer to sealants which are impervious or substantially impervious to moisture or moisture vapor. Specifically, the sealant system 23 includes a first structural sealant material 56 located near the outer end of each leg 42,44 and a second structural sealant material 58 spaced from the first structural sealant material 56 and located near the base 40. The structural sealant materials 56 and 58 are both preferably thermosetting materials, i.e. materials capable of becoming permanently rigid when heated or cured, and preferably have a tensile strength of about 200–300 psi at 200 percent elongation in accordance with ASTM D412. The structural sealant materials 56,58 are both preferably one part, hot-applied, chemically curing, silicone modified, polyurethane insulating glass sealant. An example of an acceptable sealant is PRC 590 sealant commercially available from PPG Industries, Inc. of Pittsburgh, Pa. A low MVTR sealant material 60 is positioned between the two structural sealant materials 56 and 58. The low MVTR sealant 60 preferably has a moisture vapor transmission rate of less than about 0.20 grams per square meter per day as measured on a 0.060 inch film and a gas permeance of less than about 1–3 cubic centimeters per 100 square inches per day, as measured on a 0.040 inch film as defined by ASTM D1434. Examples of an acceptable low MVTR sealant 60 include polyisobutylene (PIB) or hot melt butyl.

In the preferred embodiment of the invention shown in FIG. 3, the first structural sealant material 56 has a thickness (t) of about 0.015 to 0.025 inch (0.038–0.064 cm) and a length (x) of about 0.125 inch (0.318 cm). The low MVTR sealant 60 has a thickness (t) of about 0.015 to 0.025 inch (0.038–0.064 cm) and a length (y) of about 0.125 inch (0.0318 cm). The second structural sealant 58 has a length (z) of about 0.090 inch (0.23 cm) and, as shown in FIG. 3, preferably extends across the width of the spacer 28, e.g., extending across the perimeter groove formed by the outer surface 43 of the base 40 and the marginal edges of the glass sheets 19 and 20. This combination of sealants 56, 58 and 60 along with the flexibility of the spacer legs 42 and 44 provides enhanced structural capacity as well as low moisture and gas permeation properties to the IG unit 11.

Figure 2:
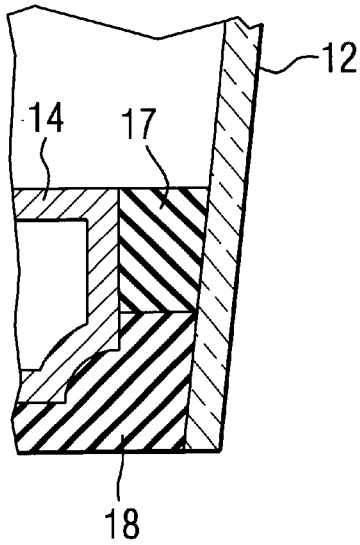
FIG. 2 PRIOR ART
FIG. 2 is a sectional view of the right side of the edge assembly of FIG. 1 when stress is applied to the prior art IG unit.

As shown in FIG. 4, when stress is applied to the IG unit 11 causing rotation or movement of the glass sheet 19, the structural sealants 56 and 58 ensure that the spacer leg 44 flexes or moves with the glass sheet 19 to help relieve the stress. For example, computer generated finite element analysis was conducted to compare the performance of a rigid, box-type spacer sealed to opposed glass sheets by a dual sealant structure (shown in FIGS. 1 and 2) with the performance of a flexible spacer sealed to opposed glass sheets by the triple sealant structure (shown in FIGS. 3 and 4). The largest amount of stress, i.e., stretching or pulling force per unit area of the sealant, was found at the inner edge of the edge seal where the peeling force is the greatest. At a glass deflection which yielded a stress of about 500 psi in the dual sealant system, the triple sealant system with the flexible spacer had a stress of only about 150 psi. This lower stress helps prevent premature failure of the sealant system 23 of the invention. Further, the dual sealant system is calculated to have a moisture vapor transmission of about $0.074\times10^{-5}$ gm-in/hr-sq.ft.-inch of mercury (Hg) while the triple sealant system of the invention with a flexible spacer was calculated to have a moisture vapor transmission of about $0.0012\times10^{-5}$ gm-in/hr-sq.ft.-inch of Hg, a reduction by a factor of about sixty four. Since the MVTR sealant 60 is dammed between the two structural sealants 56 and 58, there is little or no stretching of the MVTR sealant 60 as was common in the prior art.

A method of fabricating an IG unit 11 incorporating a sealant system 23 in accordance with the invention will now be described. As will be appreciated, the IG unit 11 and spacer frame 28 may be fabricated in any convenient manner, for example as taught in U.S. Pat. No. 5,655,282 but as modified as discussed hereinbelow to include the sealant system 23 of the invention. For example, a substrate, such as a metal sheet of 201 or 304 stainless steel having a thickness of about 0.010 inch and a length and width sufficient for producing a spacer frame of desired dimensions, may be formed by conventional rolling, bending or shaping techniques, for example as described in U.S. Pat. No. 5,655,282 . Although the sealant materials 56,58 and 60 may be positioned on the substrate before shaping, it is preferred that the sealant materials 56,58 and 60 be applied after the spacer frame 28 is shaped. The sealant materials 56,58 and 60 may be applied in any order. The second structural sealant material 58 may be applied with multiple nozzles, e.g., one nozzle applying the second structural sealant material 58 to the side of the spacer 28, i.e., on the outside of the leg 42 or 44, and another nozzle applying additional second sealant material 58 across or on the outer surface 43 of the base 40. The IG unit 11 is assembled by positioning and adhering the glass sheets 19 and 20 to the spacer frame 28 by the sealant system 23 in any convenient manner. An insulating gas, such as argon or krypton, may be introduced into the chamber 30 in any convenient manner. Together, the structural sealant material beads act to attach the glass sheets 19,20 to the spacer frame 28. In the practice of the invention, a low moisture permeation and low gas permeation, low modulus, non-structural sealant, such as PIB or hot melt butyl, is contained and constrained in the space between the two structural sealant beads. Because of the strength and structural nature of the structural sealant beads, the non-structural low MVTR material does not deform to any great extent during loading and therefore maintains its original low moisture and low gas permeation properties.

It will be readily appreciated by those skilled in the art that modifications may be made to the invention without departing from the concepts disclosed in the foregoing description. For example, although the exemplary embodiment described above utilized two glass sheets attached to the spacer, the invention is not limited to IG units having only two glass sheets but may be practiced to make IG units have two or more glass sheets, as are known in the art. Further, in the preferred embodiment of the invention, the sealant system was used with a spacer frame having a generally U-shaped cross-section; the invention, however, may be used with a spacer having any type of cross-section, e.g. of the type shown in FIG. 1. Still further, the invention was discussed by providing a portion of the sealant system in a channel formed by the outer surface of the base of the spacer frame and inner marginal edge portion of the sheets extending beyond the outer surface of the base. The invention may be practiced by not providing for any sealant in the channel or in the alternative aligning the peripheral edge of each sheet with the outer surface of the base or in another alternative by the outer surface of the base extending beyond the peripheral edges of the sheets. Still further, the layers of the sealant system may be applied or flowed onto the outer surface of the spacer frame in any convenient manner, e.g. one layer, two layers or three layers flowed onto the spacer frame. Accordingly, the particular embodiments described in detail herein are illustrative only and are not limiting to the scope of the invention, which is to be given the full breadth of the appended claims and any and all equivalents thereof.

What is claimed is:

1. An insulating glass unit, comprising:

a first glass sheet having an inner surface and an outer surface;

a second glass sheet having an inner surface and an outer surface, said glass sheets positioned such that said inner surfaces of said glass sheets are facing one another;

a spacer frame located between said first and second glass sheets, said spacer frame having a first side and a second side, with said first side located adjacent said inner surface of said first glass sheet and said second side located adjacent said inner surface of said second glass sheet; and a sealant system connecting said glass sheets to said spacer frame, said sealant system including a first structural sealant material spaced from a second structural sealant material, with a moisture barrier material located between said first and second said structural sealant materials wherein said first and second structural sealant materials are each thermoset materials and the moisture barrier material is a thermoplastic material.

2. The unit as claimed in claim 1, wherein said structural sealants include a chemically curing, silicone modified, polyurethane sealant.

3. The unit as claimed in claim 1, wherein said moisture barrier material is polyisobutylene.

4. The unit as claimed in claim 1, wherein said moisture barrier material has a moisture vapor transmission rate less than about 0.20 gram per square meter per day as measured by on a 0.60 inch film as defined by ASTM D1434.

5. The unit as claimed in claim 4, wherein said moisture barrier material has a gas permeance of less than about 1–3 cubic cm per 100 square inches per day as measured on a 0.040 inch film as defined by ASTM D1434.

6. The unit as claimed in claim 5, wherein said moisture barrier material has a thickness of about 0.20 in and a length of about 0.125 inch, said first structural sealant has a thickness of about 0.20 inch and a length of about 0.125 inch, and said second structural sealant has a length of about 0.090 inch.

7. The insulating glass unit as claimed in claim 4 wherein the spacer frame in cross section has a first leg and a second leg joined to a base to provide the spacer frame in cross section with a U-shape wherein said first side of said spacer frame is outer surface of said first leg and said second side of said spacer frame is outer surface of said second leg and said first and second legs are spaced from and out of contact with one another.

8. The insulating glass unit as claimed in claim 1, wherein said spacer frame has two spaced, substantially flexible legs extending therefrom, each leg having a first end, a second end, an inner surface and an outer surface, with the outer surfaces of said legs facing said inner surface of an adjacent glass sheet.

9. The unit as claim 1, wherein each of the structural sealant materials has a tensile strength of about 200–300 per at 200 percent elongation.

10. The unit as claimed in claim 9, wherein each said thermoset material includes a one part, hot applied, chemically curing, silicone modified, polyurethane sealant.

11. A method of making an insulating glass unit, comprising the steps of:

providing a spacer frame having a first side and a second side;

forming a sealant system adjacent said first and second spacer frame sides, said forming step practiced by placing a first structural sealant material bead, a second structural sealant material bead and a moisture barrier material bead on said spacer frame, with said moisture barrier material bead located between said first and second structural sealant material beads, wherein the first and second structural sealant material are thermoset materials having a tensile strength of about 200–300 psi at about 200 percent elongation in accordance with ASTM D412 and the moisture barrier sealant is a thermoplastic material having a moisture vapor transmission rate of less than about 0.2 gram per square meter per day as measured on a 0.60 inch film and a gas permeance of less than about 1–3 cubic cm. per 100 square inch per day as measured on a 0.040 inch film as defined by ASTM D1434;

securing a first glass sheet by said sealant system to said first side; and securing a second glass sheet by said sealant system to said second side.

12. The method as claimed in claim 11, including providing an insulating gas between said first and second glass sheets.

13. The method as claimed in claim 11, wherein said moisture barrier material is polyisobutylene.

14. The method as claimed in claim 11, wherein said moisture barrier material bead has a length of about 0.125 inch and a thickness of about 0.020 inch.

15. The method as claimed in claim 11, wherein said first structural sealant material bead has a thickness of about 0.020 inch and a length of about 0.125 inch.

16. The method as claimed in claim 11, wherein said second structural sealant material bead has a length of about 0.090 inch.

17. The method as claimed in claim 11, wherein said spacer frame includes a pair of spaced, substantially flexible legs interconnected by a base to space said legs from one another and maintain the legs spaced from one another.

18. A sealant system for connecting glass sheets to a spacer frame in an insulating glass unit, said sealant system comprising:

a first structural sealant material spaced from a second structural sealant material each of the structural sealant materials are thermoset materials having a tensile strength of about 200–300 psi at about 200 percent elongation in accordance with ASTM D412; and a moisture barrier material located between said first and second structural sealant materials, the moisture barrier material is a thermoplastic material having a moisture vapor transmission rate of less than 0.20 gram per square meter per day as measured on a 0.60 inch film and a gas permeance of less than about 1–3 cubic cm. per 100 square inches per day as measured on a 0.040 inch film as defined by ASTM D1434.

19. The system as claimed in claim 18, wherein said first and second structural sealant materials are thermosetting materials.

20. The system as claimed in claim 18, wherein said moisture barrier material is a thermoplastic material.

* * * * *